US010150212B2

(12) United States Patent
Yu

(10) Patent No.: US 10,150,212 B2
(45) Date of Patent: Dec. 11, 2018

(54) HAND TOOL WITH FOLDABLE WORKING PART

(71) Applicants: Hung-Chao Yu, Taichung (TW); EASY TOOL ENTERPRISE CO., LTD., Taichung (TW)

(72) Inventor: Hung-Chao Yu, Taichung (TW)

(73) Assignees: Hung-Chao Yu, Taichung (TW); Easy Tool Enterprise Co., Ltd., Taichung (TW)

( * ) Notice: Subject to any disclaimer, the term of this patent is extended or adjusted under 35 U.S.C. 154(b) by 223 days.

(21) Appl. No.: 15/354,045

(22) Filed: Nov. 17, 2016

(65) Prior Publication Data

US 2017/0259423 A1 Sep. 14, 2017

(30) Foreign Application Priority Data

Mar. 11, 2016 (TW) ..... 105203434 A

(51) Int. Cl.

| | |
|---|---|
| ***B25G 1/08*** | (2006.01) |
| ***B25B 15/00*** | (2006.01) |
| ***B25B 23/00*** | (2006.01) |
| ***B25B 15/04*** | (2006.01) |

(52) U.S. Cl.

CPC ..... *B25G 1/085* (2013.01); *B25B 15/005* (2013.01); *B25B 15/04* (2013.01); *B25B 23/0028* (2013.01)

(58) Field of Classification Search

CPC ... B25B 15/005; B25B 15/04; B25B 23/0028; B25B 23/0035; B25B 23/0042; B25G 1/063; B25G 1/066; B25G 1/085; B25G 1/10

See application file for complete search history.

(56) References Cited

U.S. PATENT DOCUMENTS

| | | | | |
|---|---|---|---|---|
| 2,518,139 | A * | 8/1950 | Hallowell | B25B 23/0035 279/75 |
| 6,308,599 | B1 * | 10/2001 | Fu-Hui | B25G 1/066 81/177.4 |
| 6,397,709 | B1 * | 6/2002 | Wall | B25B 15/00 81/177.4 |
| 7,905,163 | B1 * | 3/2011 | Chiang | B25B 15/001 81/177.7 |
| 8,430,003 | B1 * | 4/2013 | Johnson | B23Q 13/00 81/427.5 |
| 8,656,811 | B2 * | 2/2014 | Ho | B25B 15/02 81/177.5 |
| 8,783,138 | B2 * | 7/2014 | Johnson | B23Q 13/00 81/439 |

(Continued)

*Primary Examiner* — David B Thomas
(74) *Attorney, Agent, or Firm* — Rosenberg, Klein & Lee

(57) ABSTRACT

A hand tool includes a handle having a room defined therein. A first and second lugs extend from the front end of the handle. A space is defined between the first and second lugs and communicates with the room. A working part is to be connected with a bit, and has a pivotal portion which is pivotably connected between the two lugs. A plate is connected to at least one of the first and second lugs, and has multiple first recesses and a second recesses. A positioning member is located between the pivotal portion and the plate so as to be engaged with one of the first and second recesses to position an angular position of working part. The working part is able to be pivoted and received in the room in the handle.

10 Claims, 20 Drawing Sheets

(56) References Cited

U.S. PATENT DOCUMENTS

| | | | | |
|---|---|---|---|---|
| 8,869,658 | B2 * | 10/2014 | Chou | B25G 1/007<br>403/322.4 |
| 2004/0139828 | A1 * | 7/2004 | Chang | B25B 13/461<br>81/177.9 |
| 2008/0156149 | A1 * | 7/2008 | Ho | B25B 15/04<br>81/63.1 |

* cited by examiner

HAND TOOL WITH FOLDABLE WORKING PART

BACKGROUND OF THE INVENTION

1. Fields of the Invention

The present invention relates to a hand tool, and more particularly, to a hand tool with a handle and a working part which is foldable and received in the handle.

2. Descriptions of Related Art

The conventional hand tool 10 as disclosed in FIGS. 1 to 4, generally includes a handle 11 which includes two lugs 111 extending from the front end thereof and a space 112 is defined between the two lugs 111. A working part 12 includes a bit 121 connected to the front end thereof, and a pivotal portion 122 is formed on the rear end of the working part 12. The pivotal portion 122 is pivotably connected between the two lugs 111 and located in the space 112 by extending a pin 13 extending through the lugs 111 and the pivotal portion 122. The pivotal portion 122 includes multiple recesses 123 defined in two sides thereof. One of the lugs 111 further has a hole 113 which communicates with the space 112. A bead 14 and a spring 15 are received in the hole 113, and the bead 14 is biased by the spring 15 and engaged with one of the recesses 123 to position the angular position of the working part 12. When the working part 12 and the handle 11 shares a common axis, the hand tool 10 is used as a conventional screwdriver. The hand tool 10 can also be used by pivoting the working part 12 to an specific angular position and the bead 14 is biased by the spring 15 and engaged with one of the recesses 123 to position that angular position of the working part 12 as shown in FIG. 4.

However, the hand tool 10 includes the handle 11 and the working part 12 so that it occupies a certain space which is not convenient for stored and carry.

Besides, the recesses 123 formed in the pivotal portion 122 needs extra machining processes which increases the manufacturing cost.

The present invention intends to provide a hand tool that includes a handle which includes a room so that the working part can be foldable and received in the room.

SUMMARY OF THE INVENTION

The present invention relates to a hand tool and comprises a handle which having room defined therein. A first lug and a second lug extend from the front end of the handle. A space is defined between the first and second lugs and communicates with the room. A working part has a first end and a second end, wherein the first end is to be connected with a bit. A pivotal portion is formed on the second end of the working part. The pivotal portion is inserted in the space and pivotably connected between the first and second lugs by extending a pin through the first and second lugs and the pivotal portion. A plate is connected to at least one of the first and second lugs. The plate has multiple first recesses and a second recesses defined in the first side thereof. A positioning member is located between the pivotal portion and the plate so as be engaged with one of the first and second recesses to position the working part relative to the handle. The working part is able to be pivoted and received in the room in the handle.

Preferably, the plate is made by way of powder metallurgy.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
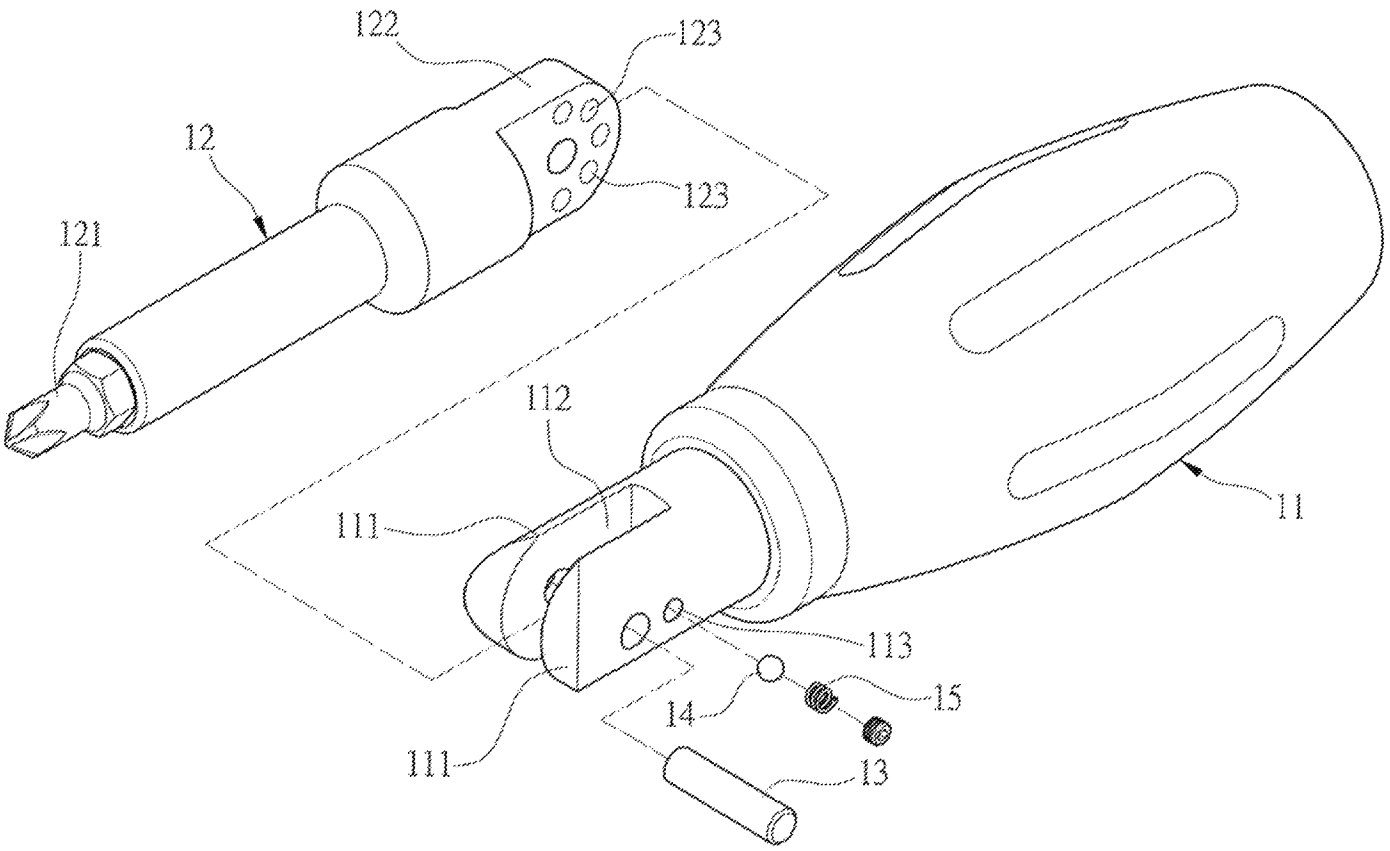
FIG. 1 is an exploded view to show a conventional hand tool.
Figure 2:
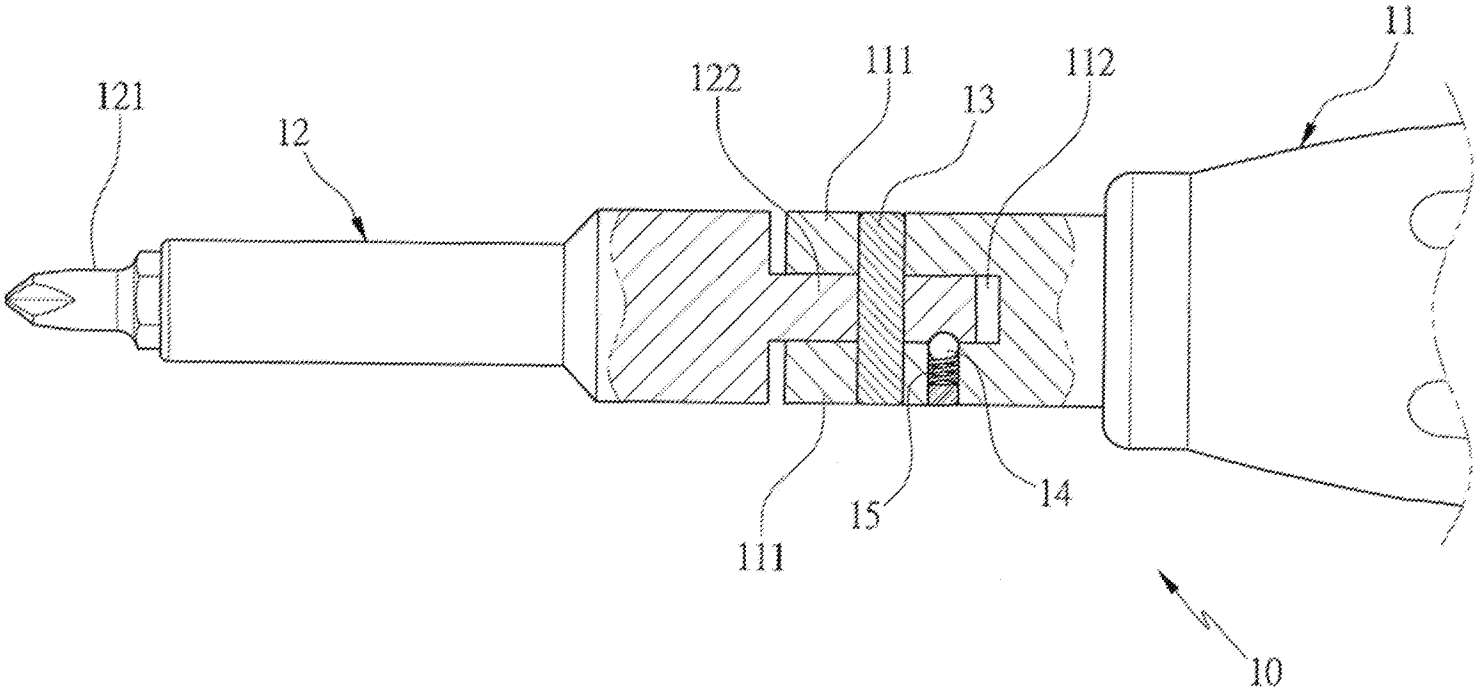
FIG. 2 is a partial cross sectional view of the conventional hand tool.
Figure 3:
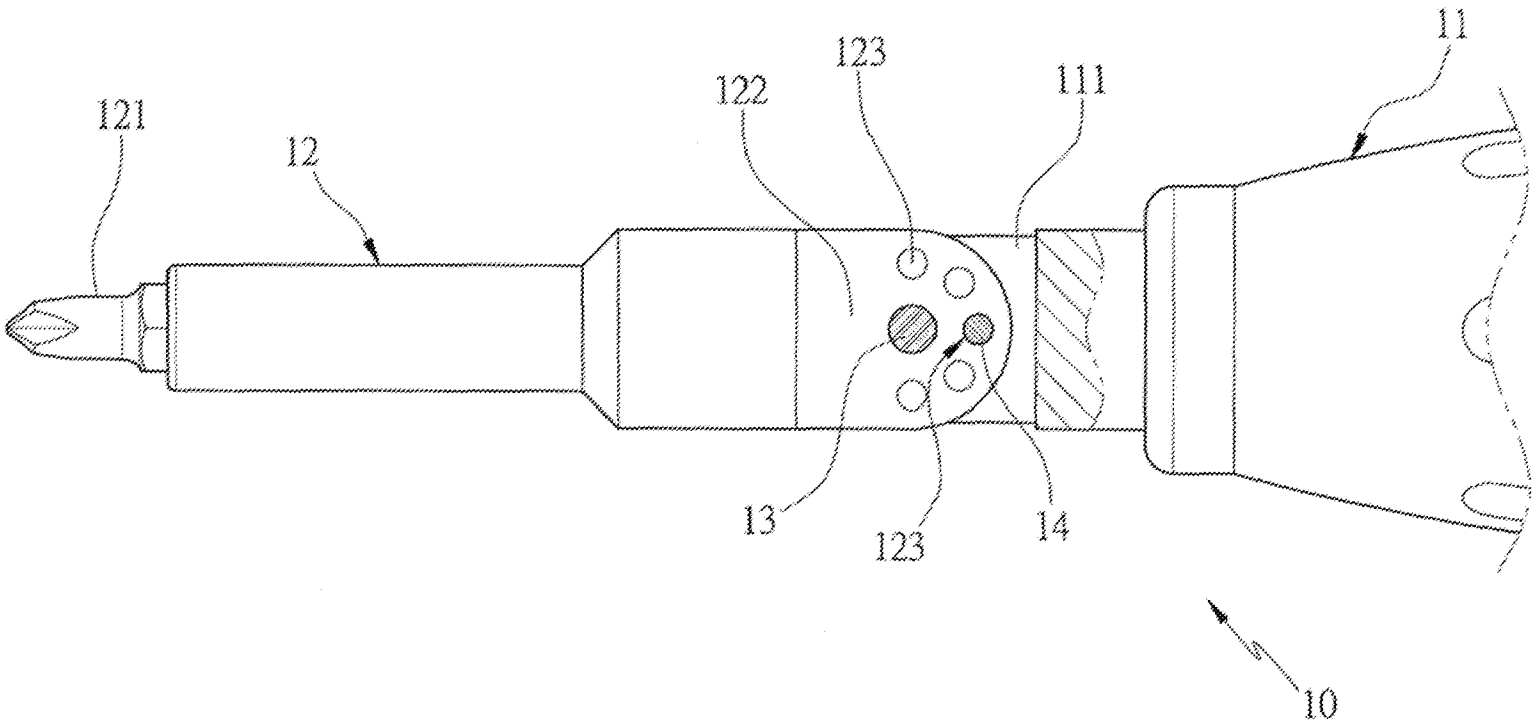
FIG. 3 is a partial cross sectional view to show the positioning of the working part of the conventional hand tool.
Figure 4:
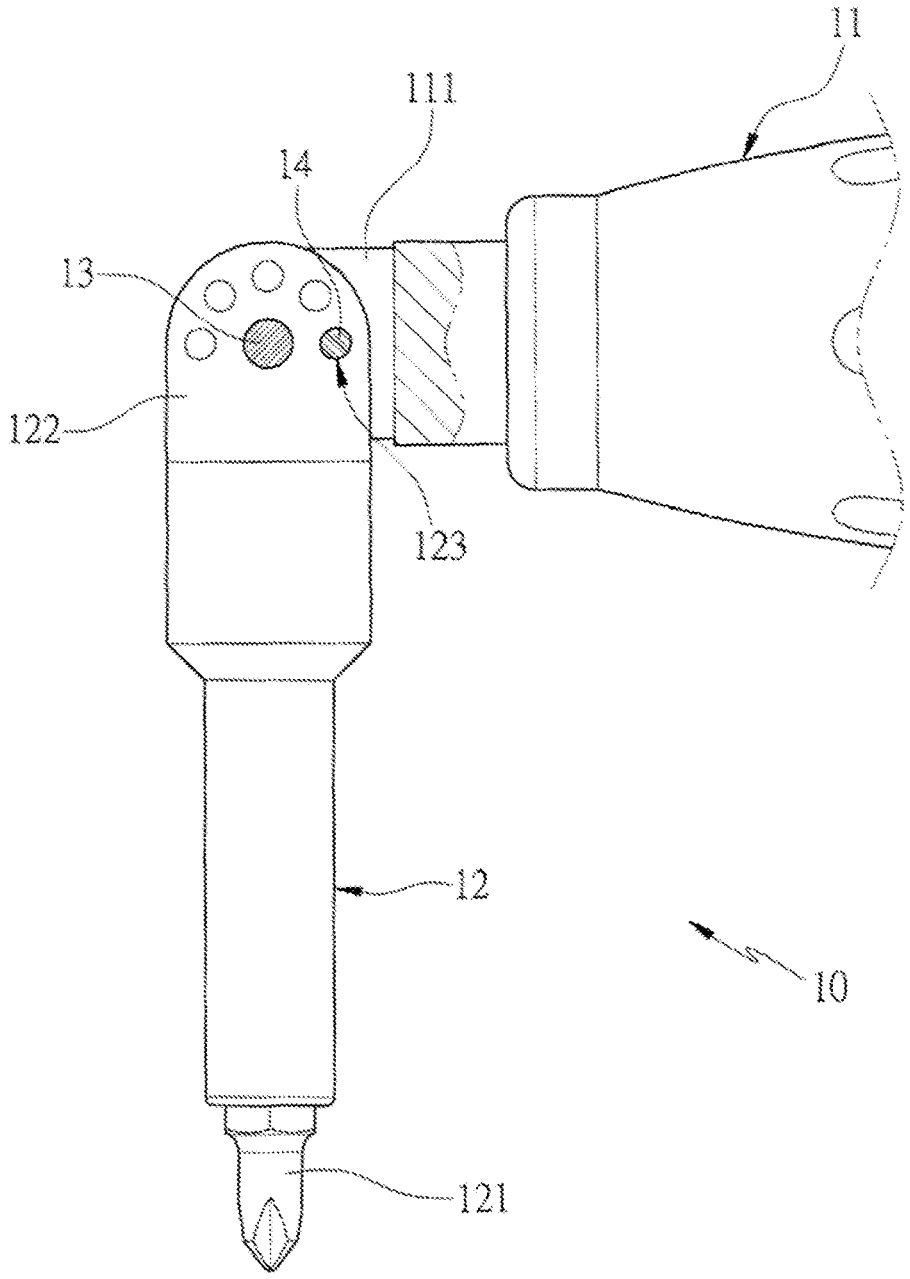
FIG. 4 is another partial cross sectional view to show that the working part is positioned at an angular position of the conventional hand tool.
Figure 5:
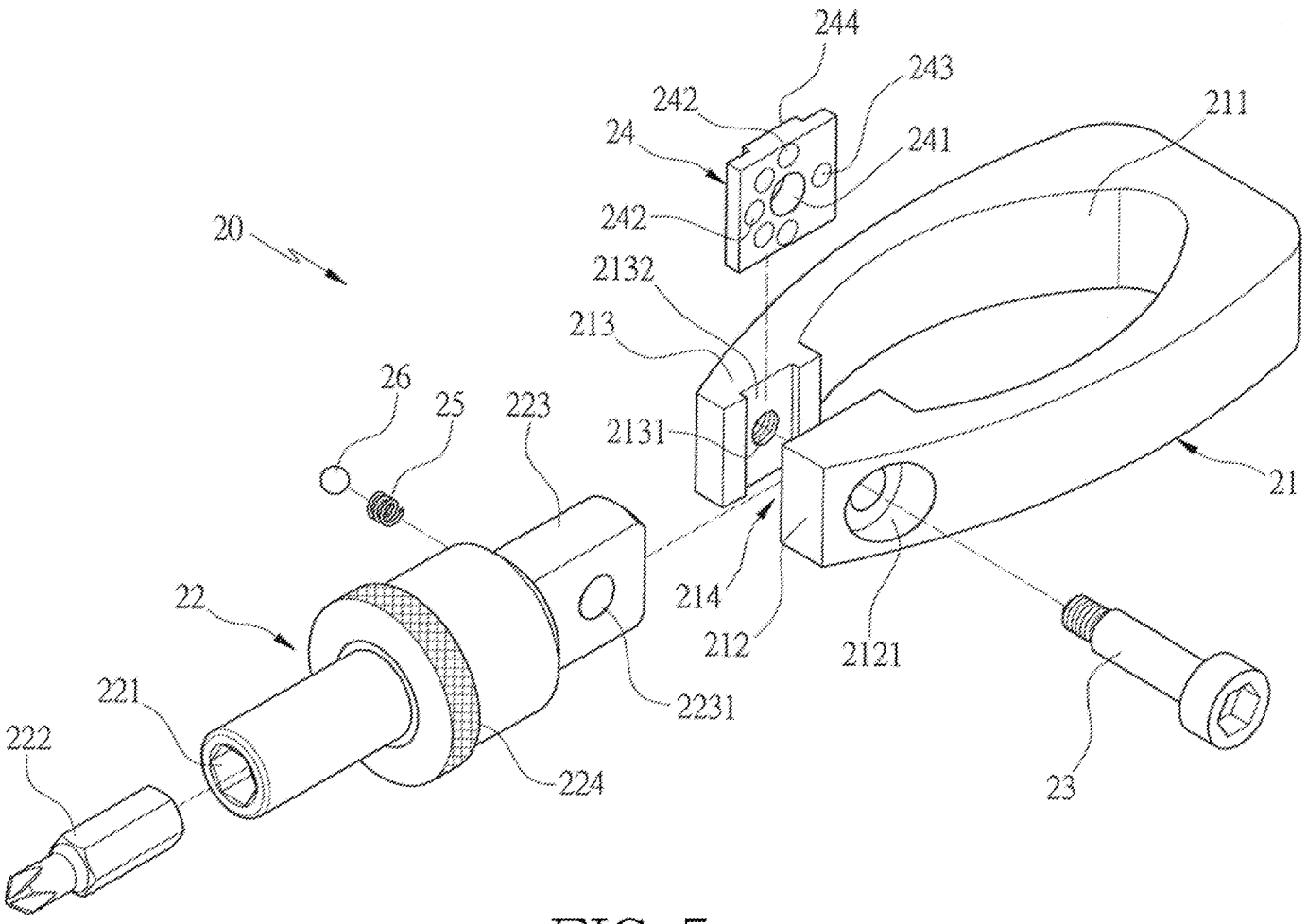
FIG. 5 is an exploded view to show the hand tool of the present invention.
Figure 6:
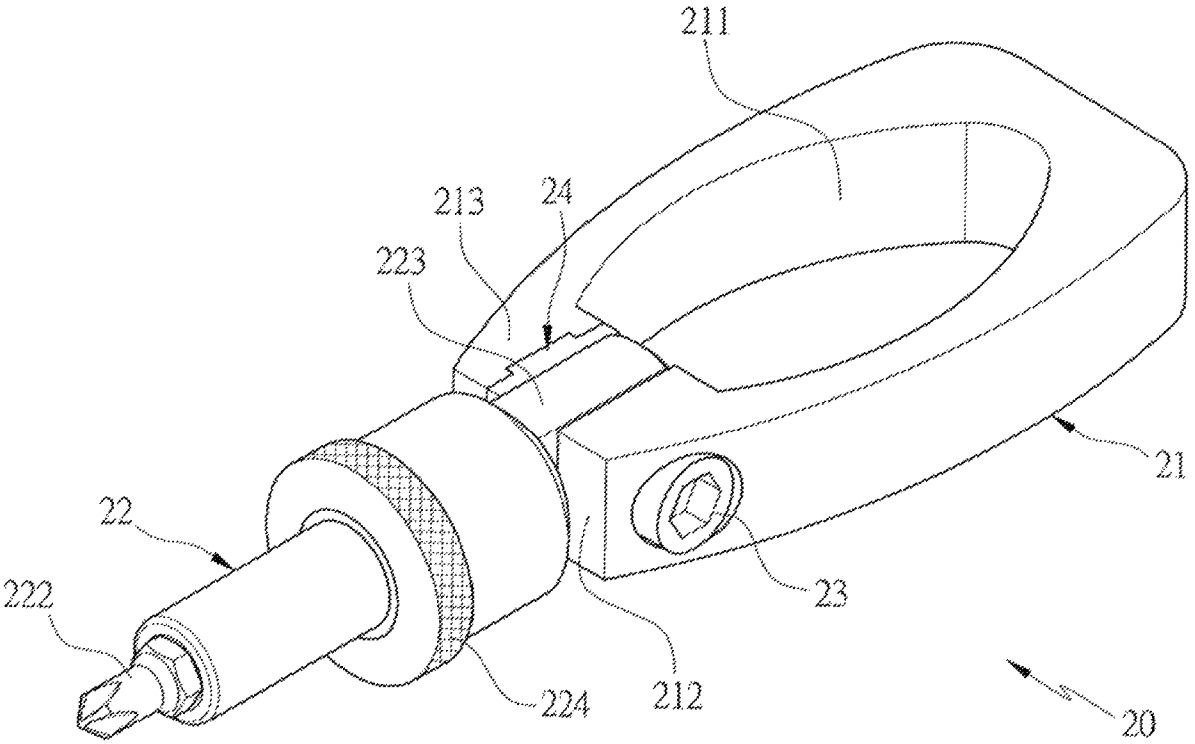
FIG. 6 is a perspective view to show the hand tool of the present invention.
Figure 7:
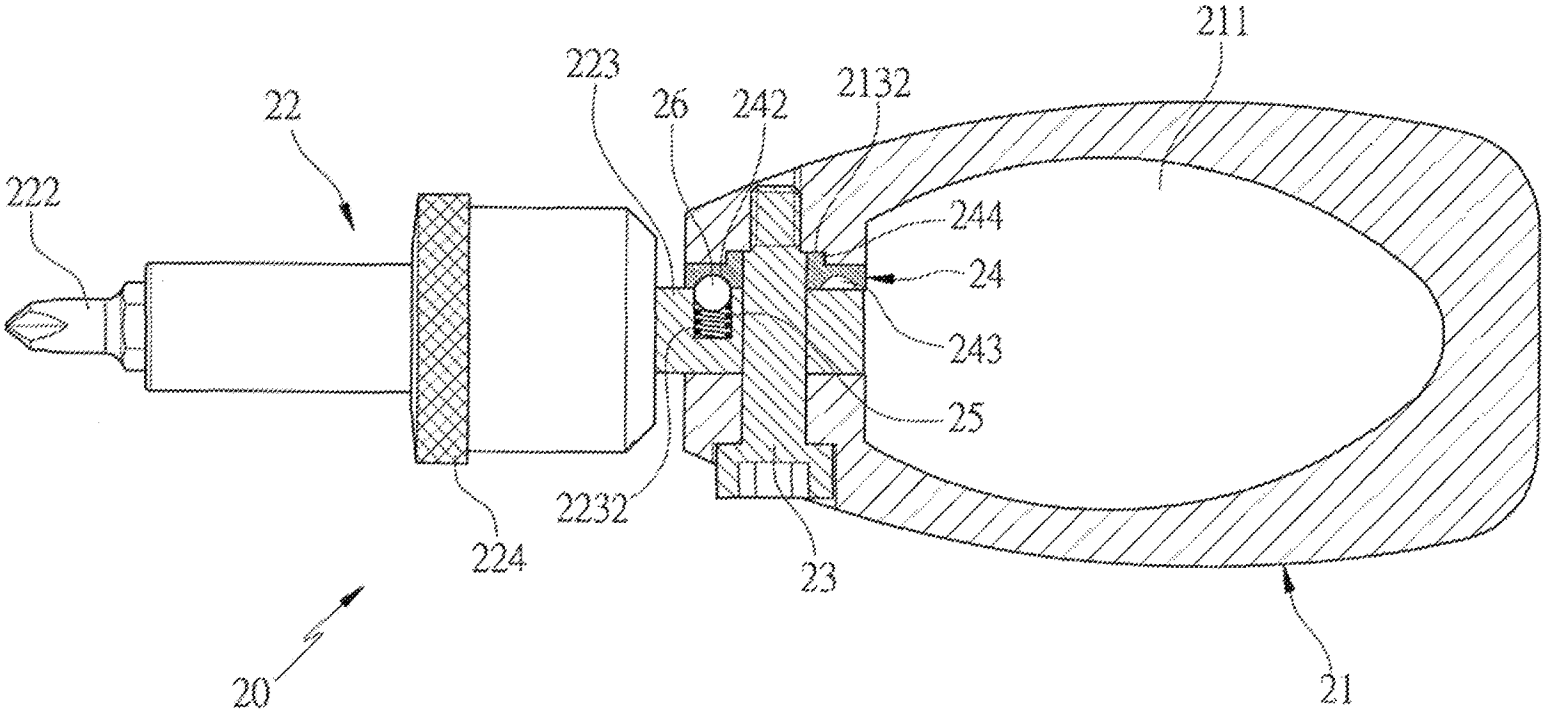
FIG. 7 is a cross sectional view of the hand tool of the present invention.
Figure 8:
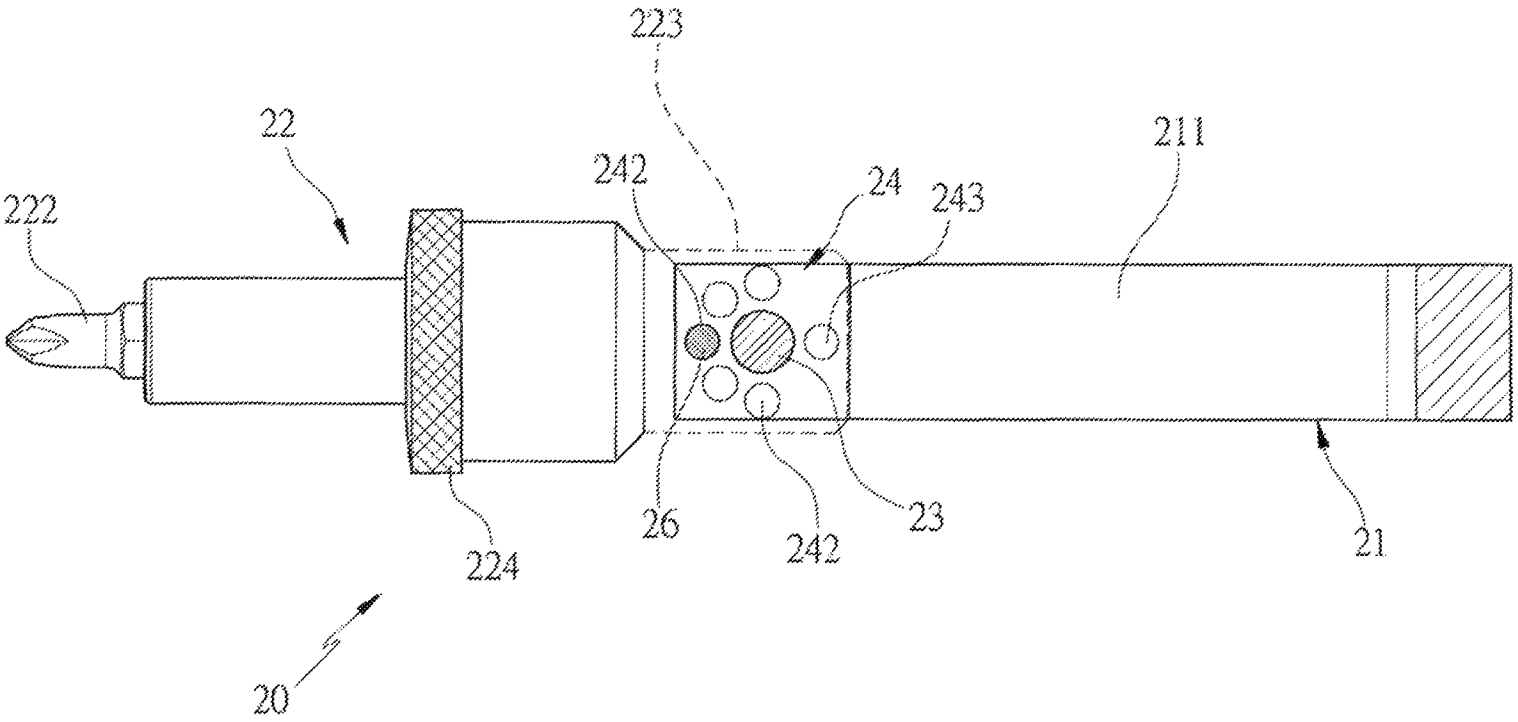
FIG. 8 is another cross sectional view of the hand tool of the present invention.

Referring to FIGS. 5 to 8, the hand tool 10 of the present invention comprises a handle 21 which is a one-piece handle and has a room 211 defined therein. Specifically, the handle 21 is a U-shaped handle and the room 211 is a substantially oval-shaped room which extends through the handle 21. A first lug 212 and a second lug 213 extend from the front end of the handle 21, and a space 214 is defined between the first and second lugs 212, 213 and communicates with the room 211. The first lug 212 has a stepped hole 2121 and the second lug 213 has a threaded hole 2131.

A working part 22 has a first end and a second end, wherein the first end of the working part 22 has an engaging hole 221 so as to be connected with a bit 222. The first lug 212 has a stepped hole 2121 and the second lug 213 has a threaded hole 2131. A pivotal portion 223 is formed on the second end of the working part 22. The pivotal portion 223 of the working part 22 has a passage 2231. A plate 24 is connected to the second lug 213 and has multiple first recesses 242 and a second recesses 243 defined in the first side thereof. The first recesses 242 of the plate 24 are located closer to the first end of the handle 21 than the second recess 243. Specifically, the plate 24 has a ridge 244 extending from the second side thereof, and the second lug 213 includes a slot 2132 in which the ridge 244 slides. The plate 24 has an aperture 241 defined therethrough.

The pivotal portion 223 is inserted in the space 214 and pivotably connected between the first and second lugs 212, 213 by extending a pin 23 through the stepped hole 212, the passage 2231, the aperture 241 and is threadedly connected to the threaded hole 2131. The working part 22 further has a ratchet unit 224 which controls the direction of rotation of the bit 222. The plate 24 is made by way of powder metallurgy so that the first and second recesses 242, 243 are formed integrally with the plate 24.

The pivotal portion 223 further has a reception recess 2232. A resilient member 25 and the positioning member 26 are received in the reception recess 2232. The positioning member 26 is biased by the resilient member 25 and engaged with one of the first and second recesses 242, 243 to position the working part 22.

Figure 9:
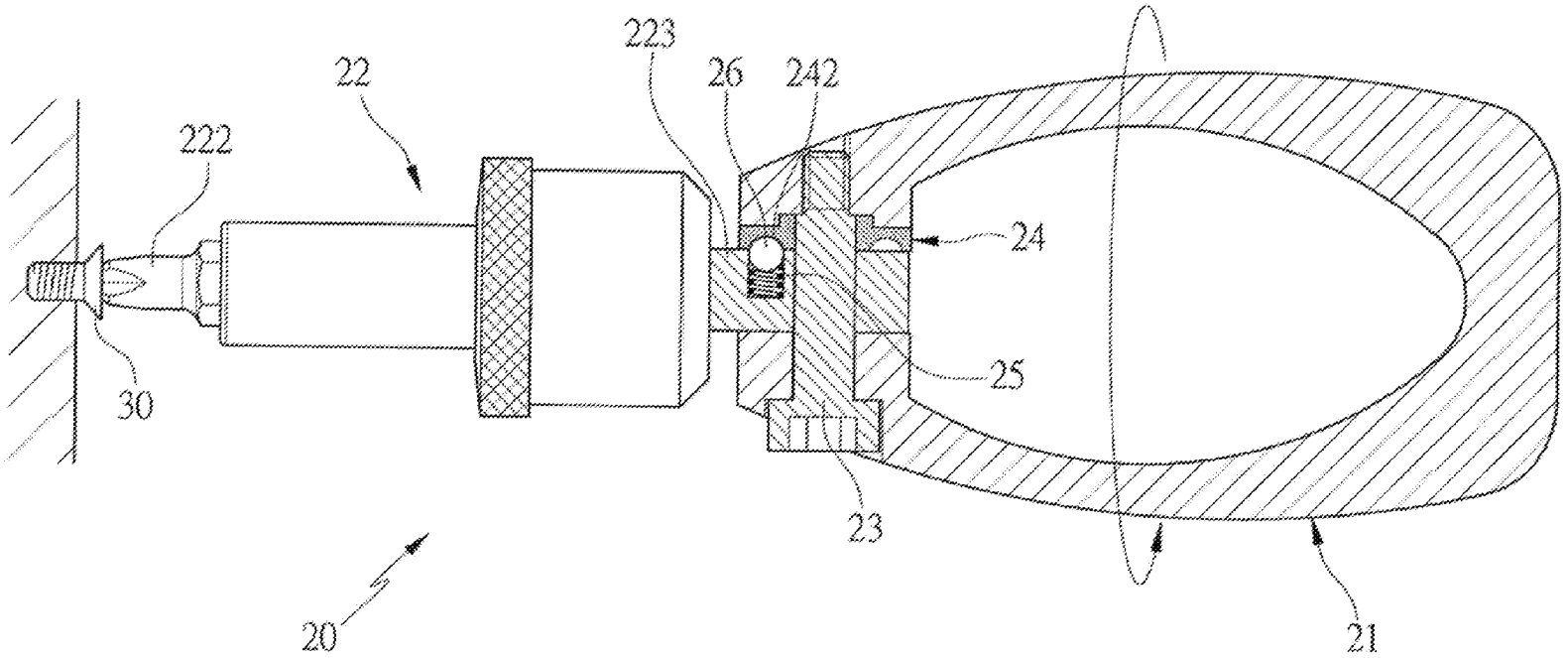
FIG. 9 is a cross sectional view to show that the hand tool of the present invention is used to fasten a screw.

As shown in FIG. 9, the hand tool 10 is used as a common screwdriver to fasten a screw 30 by the bit 222 connected to the engaging hole 221 of the working part 22.

Figure 10:
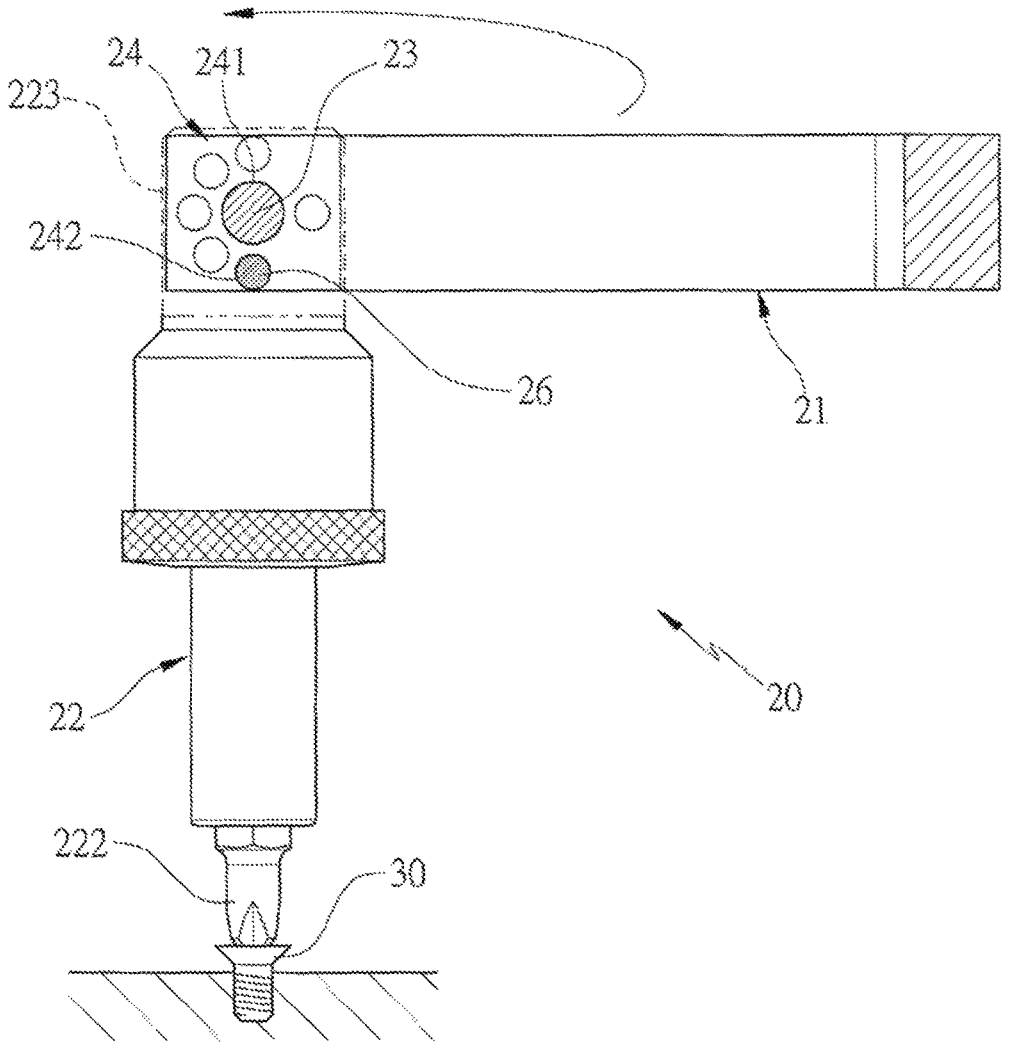
FIG. 10 is a partial cross sectional view to show that the handle is pivoted to be perpendicular to the working part which is used to fasten a screw.

As shown in FIG. 10, the working part 22 is able to be pivoted relative to the handle 21 and positioned by engaging the positioning member 26 with one of the first recesses 242. In this drawing, the handle 21 is perpendicular to the working part 22, so that the user may rotate the handle 21 to apply torque to rotate the bit 222 to fasten the screw 30.

Figure 11:
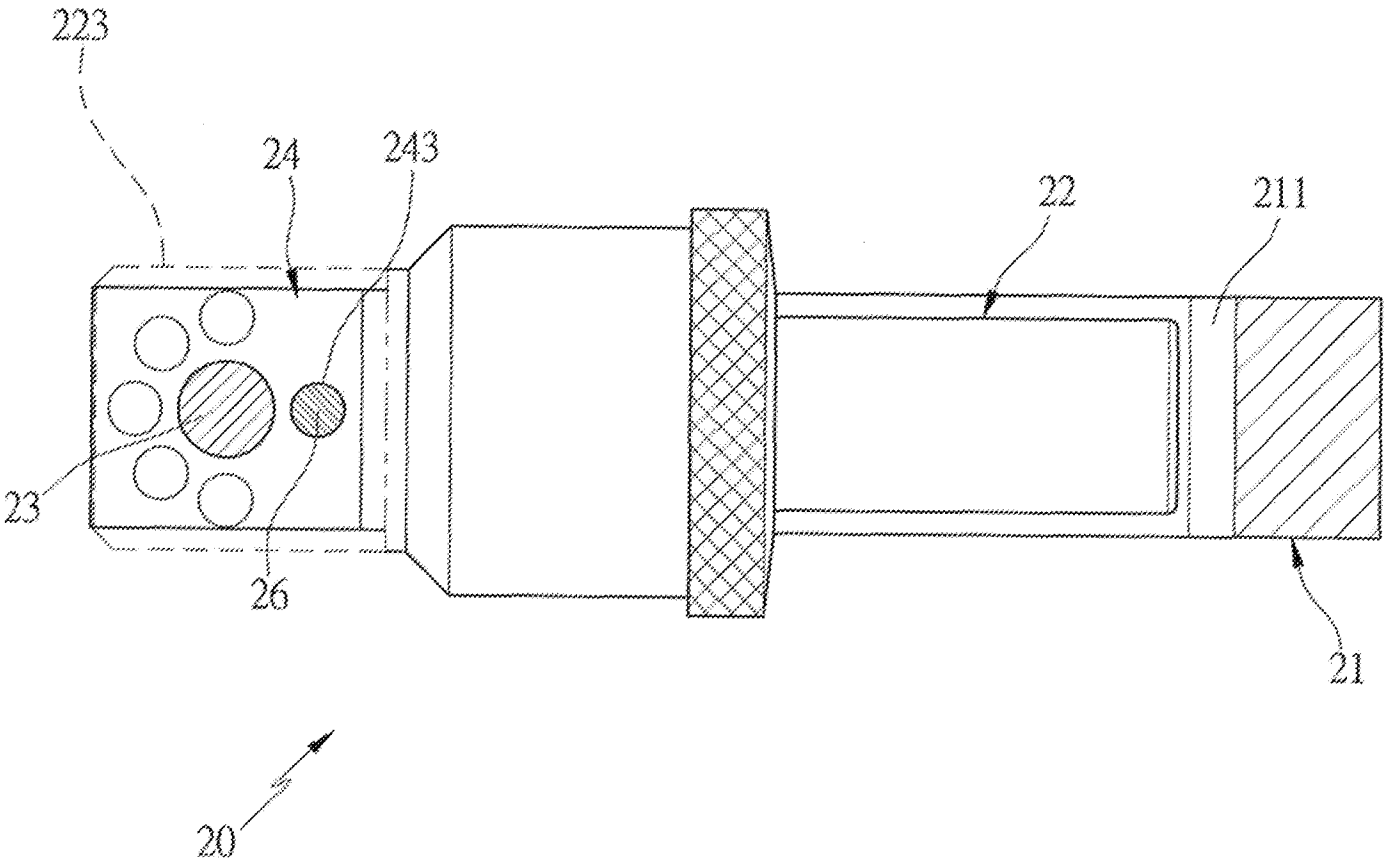
FIG. 11 is a side view to show that the working part is received in the handle.
Figure 12:
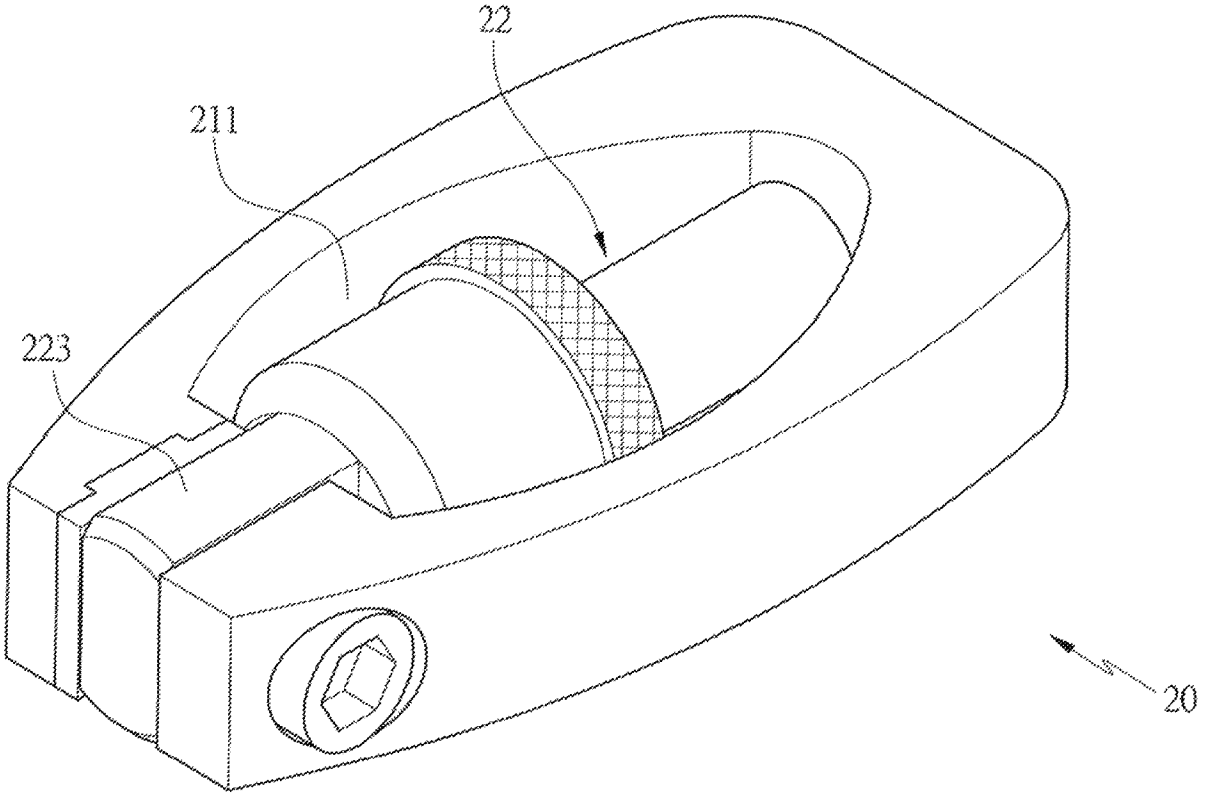
FIG. 12 is a perspective view to show that the working part is received in the handle.
Figure 13:
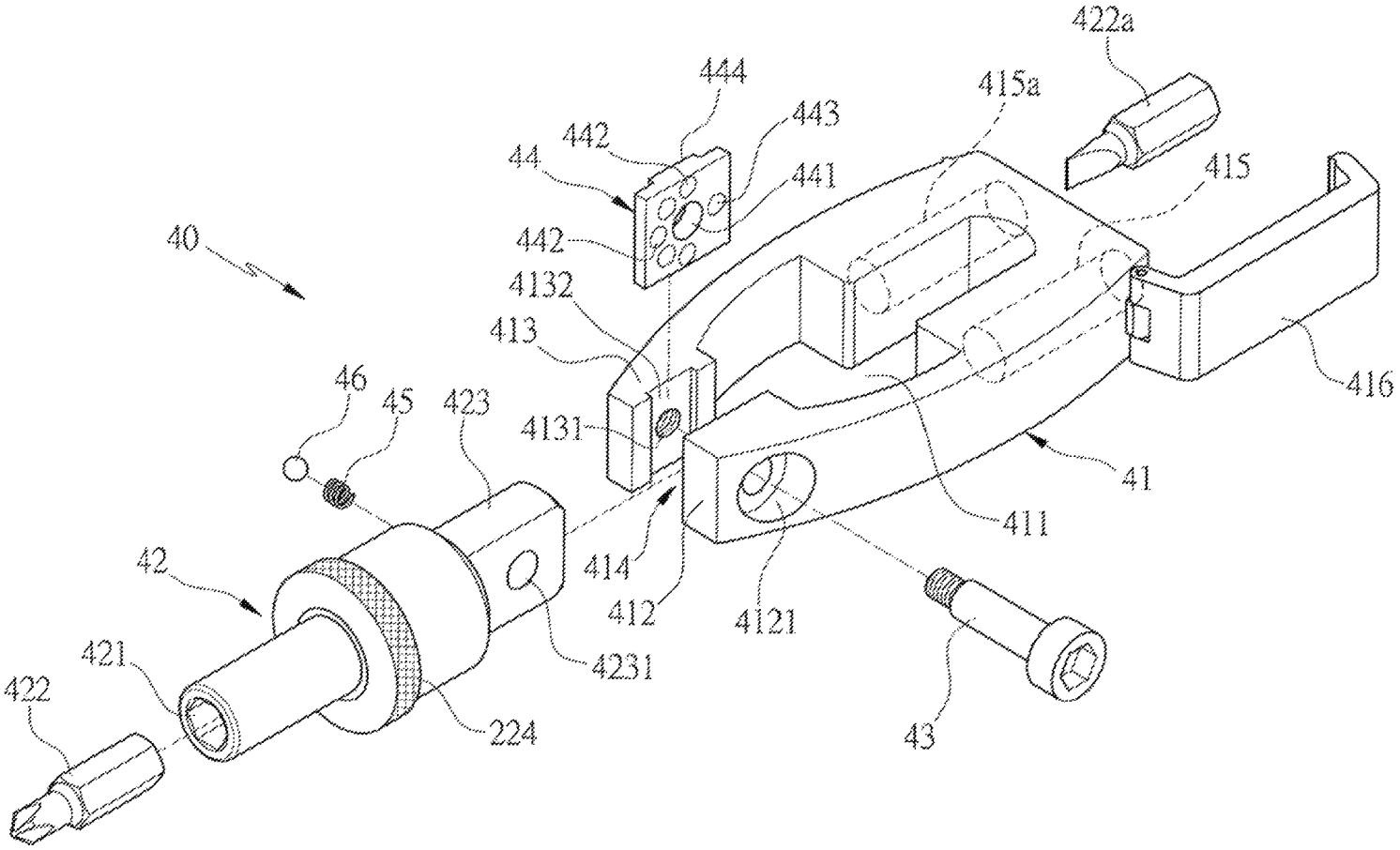
FIG. 13 is an exploded view to show the second embodiment of the hand tool of the present invention.
Figure 14:
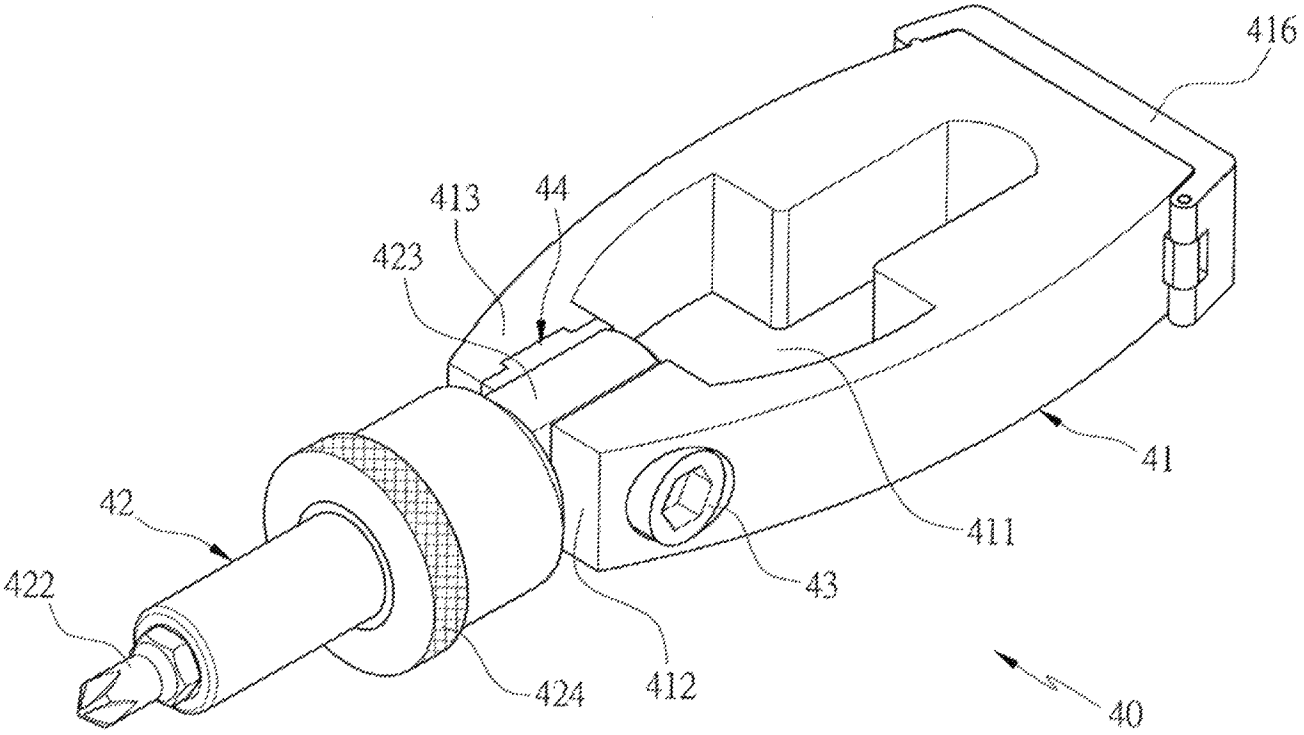
FIG. 14 is a perspective view to show the second embodiment of the hand tool of the present invention.
Figure 15:
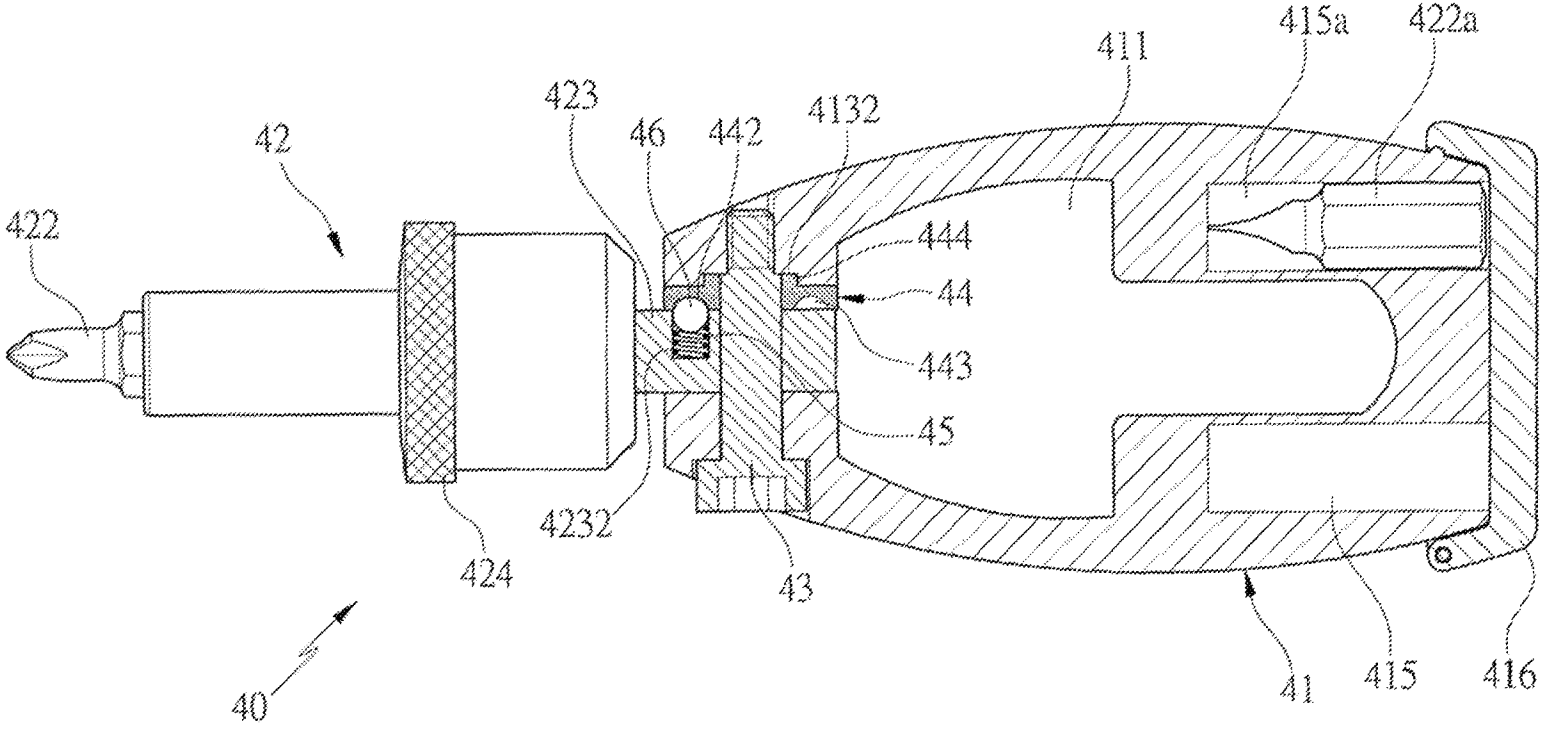
FIG. 15 is a cross sectional view of the second embodiment of the hand tool of the present invention.
Figure 16:
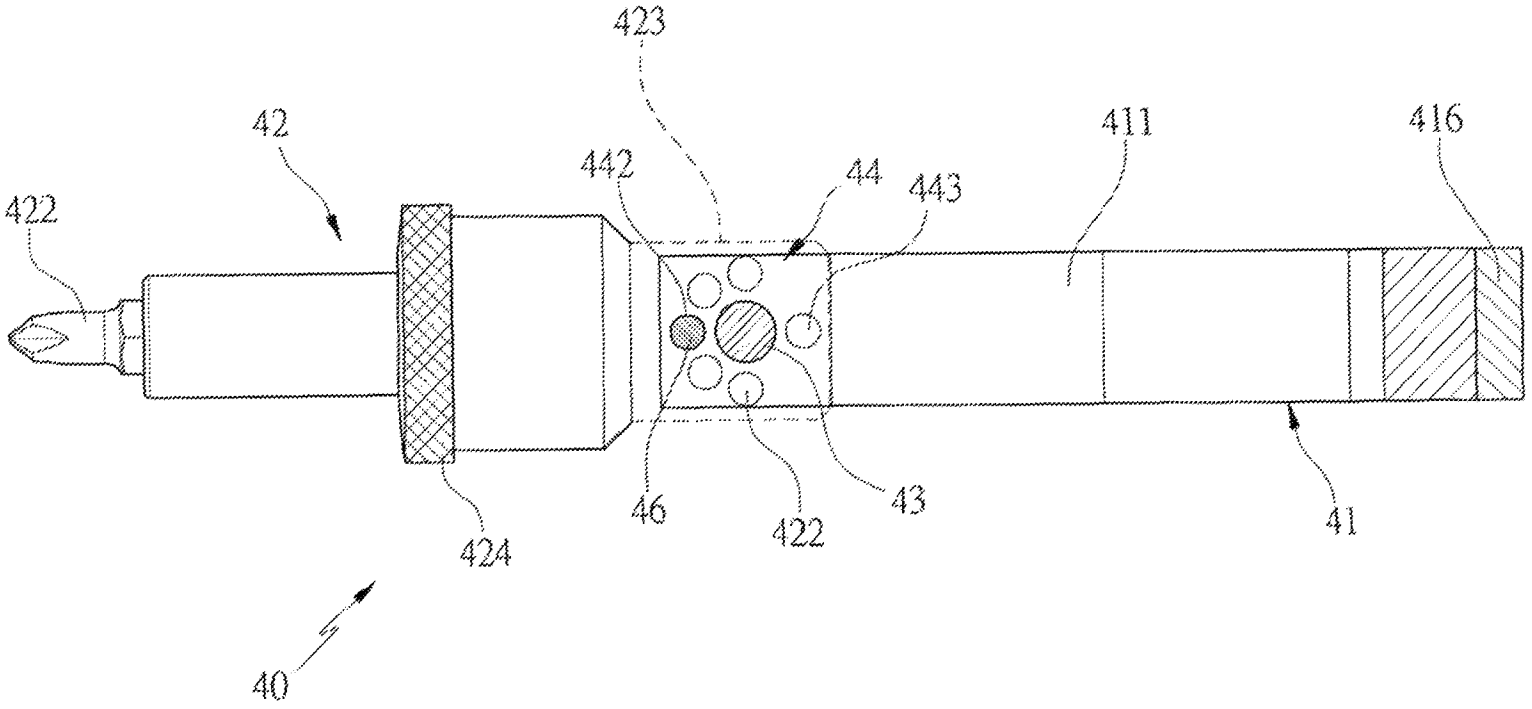
FIG. 16 is another cross sectional view of the second embodiment of the hand tool of the present invention.

As shown in FIGS. 11 and 12, the working part 22 is pivoted toward the handle 21 and received in the room 211 in the handle 21, wherein the positioning member 26 is engaged with the second recess 243 to keep the working part 22 is received in the room 211 in the handle 21.

As shown in FIGS. 13 to 16, the second embodiment of the hand tool 40 of the present invention comprises a handle 41 which is a one-piece handle and has a room 411 defined therein. Specifically, the handle 41 is a U-shaped handle and the room 411 is a substantially T-shaped room which extends through the handle 41. A first lug 412 and a second lug 413 extend from the front end of the handle 41, and a space 414 is defined between the first and second lugs 412, 413 and communicates with the room 411. The first lug 412 has a stepped hole 4121 and the second lug 413 has a threaded hole 4131. The handle 41 includes multiple receiving recesses 415 defined in the second end thereof. A cap 416 is pivotably connected to the second end of the handle 41 and seals the receiving recesses 415. The receiving recesses 415 are designed to receive extra bits 422, 422*a*.

A working part 42 has a first end and a second end, wherein the first end of the working part 42 has an engaging hole 421 so as to be connected with a bit 422. The first lug 412 has a stepped hole 4121 and the second lug 413 has a threaded hole 4131. A pivotal portion 423 is formed on the second end of the working part 42. The pivotal portion 423 of the working part 42 has a passage 4231. A plate 44 is connected to the second lug 413 and has multiple first recesses 442 and a second recesses 443 defined in the first side thereof. The first recesses 442 of the plate 24 are located closer to the first end of the handle 41 than the second recess 443. Specifically, the plate 44 has a ridge 444 extending from the second side thereof, and the second lug 413 includes a slot 4132 in which the ridge 444 slides. The plate 44 has an aperture 441 defined therethrough.

The pivotal portion 423 is inserted in the space 414 and pivotably connected between the first and second lugs 412, 413 by extending a pin 43 through the stepped hole 4121, the passage 4231, the aperture 441 and is threadedly connected to the threaded hole 4131. The working part 42 further has a ratchet unit 424 which controls the direction of rotation of the bit 422. The plate 44 is made by way of powder metallurgy so that the first and second recesses 442, 443 are formed integrally with the plate 44.

The pivotal portion 423 further has a reception recess 4232. A resilient member 45 and the positioning member 46 are received in the reception recess 4232. The positioning member 46 is biased by the resilient member 45 and engaged with one of the first and second recesses 442, 443 to position the working part 42.

Figure 17:
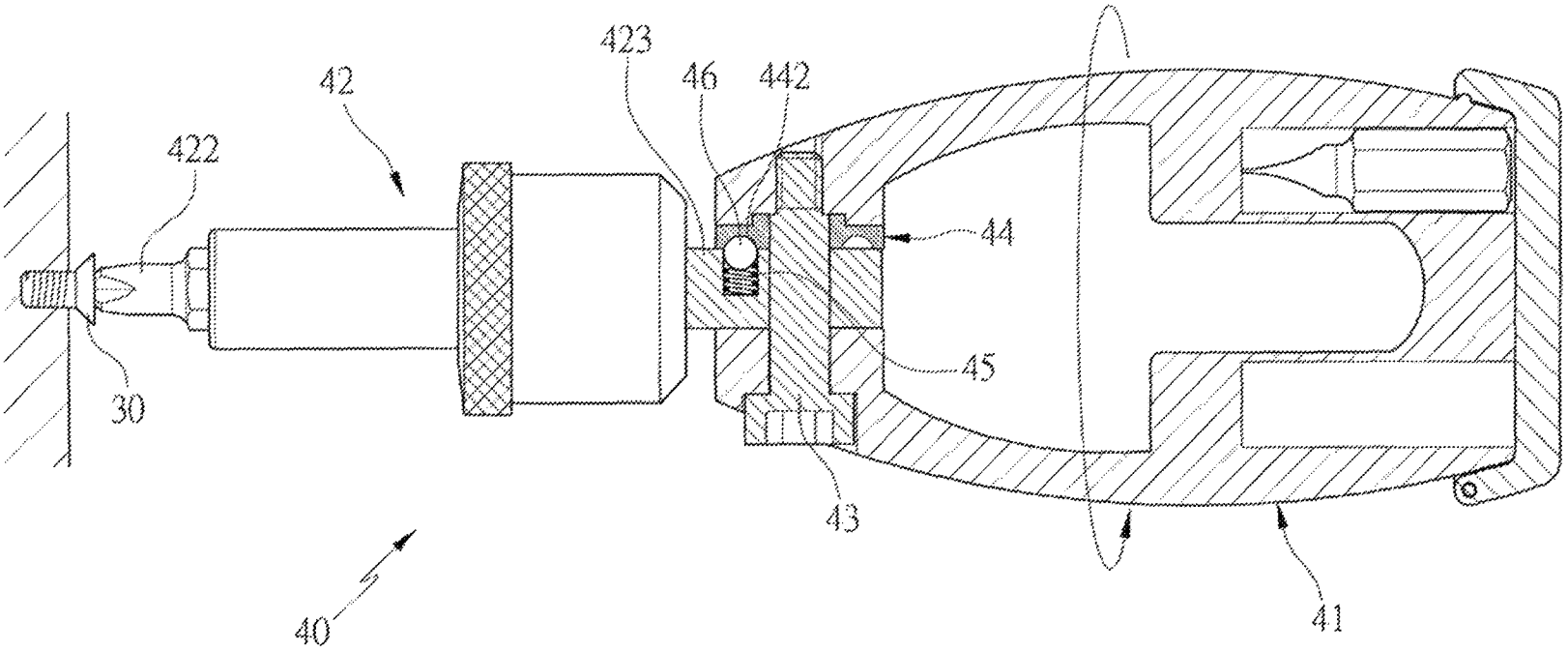
FIG. 17 is a cross sectional view to show that the second embodiment of the hand tool of the present invention is used to fasten a screw.

As shown in FIG. 17, the hand tool is used as a common screwdriver to fasten a screw 30 by the bit 422 connected to the engaging hole 421 of the working part 42.

Figure 18:
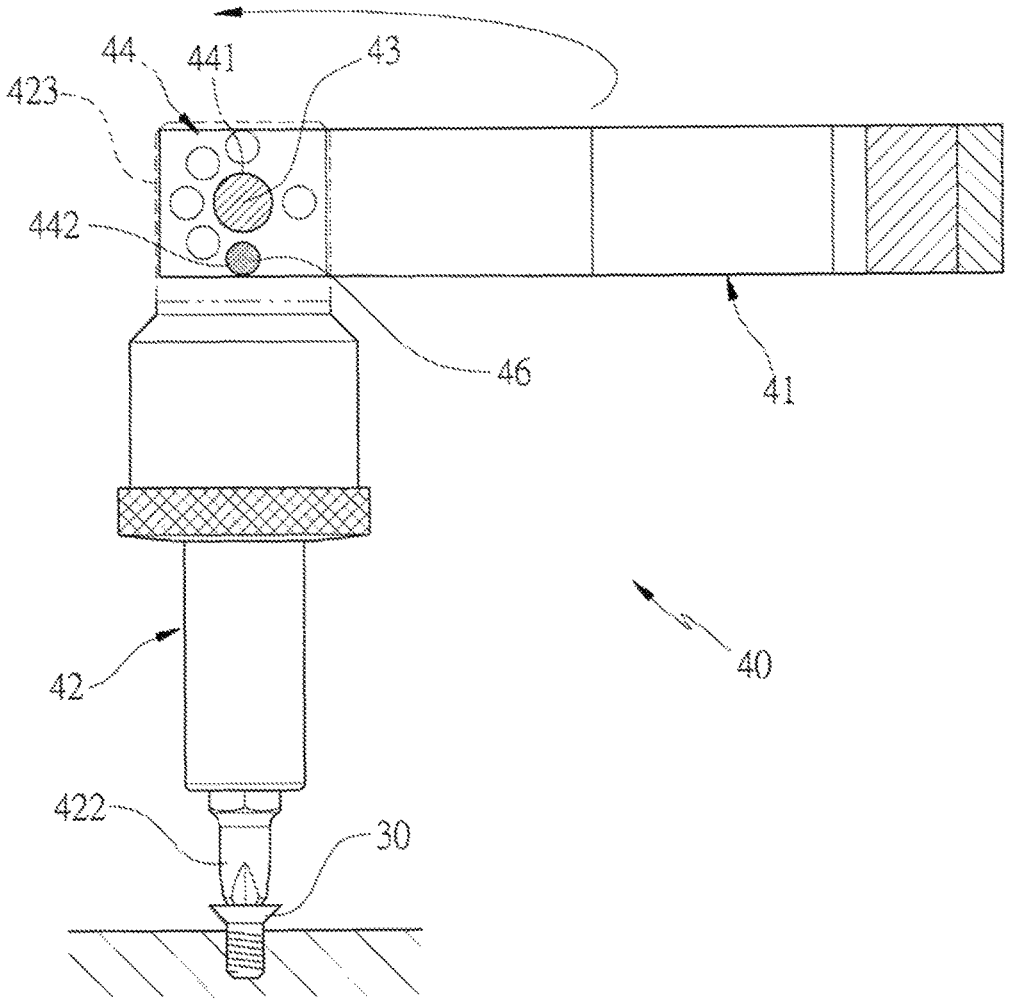
FIG. 18 is a partial cross sectional view to show that the second embodiment of the handle is pivoted to be perpendicular to the working part which is used to fasten a screw.

As shown in FIG. 18, the working part 42 is able to be pivoted relative to the handle 41 and positioned by engaging the positioning member 46 with one of the first recesses 442. In this drawing, the handle 41 is perpendicular to the working part 42, so that the user may rotate the handle 41 to apply torque to rotate the bit 422 to fasten the screw 30.

Figure 19:
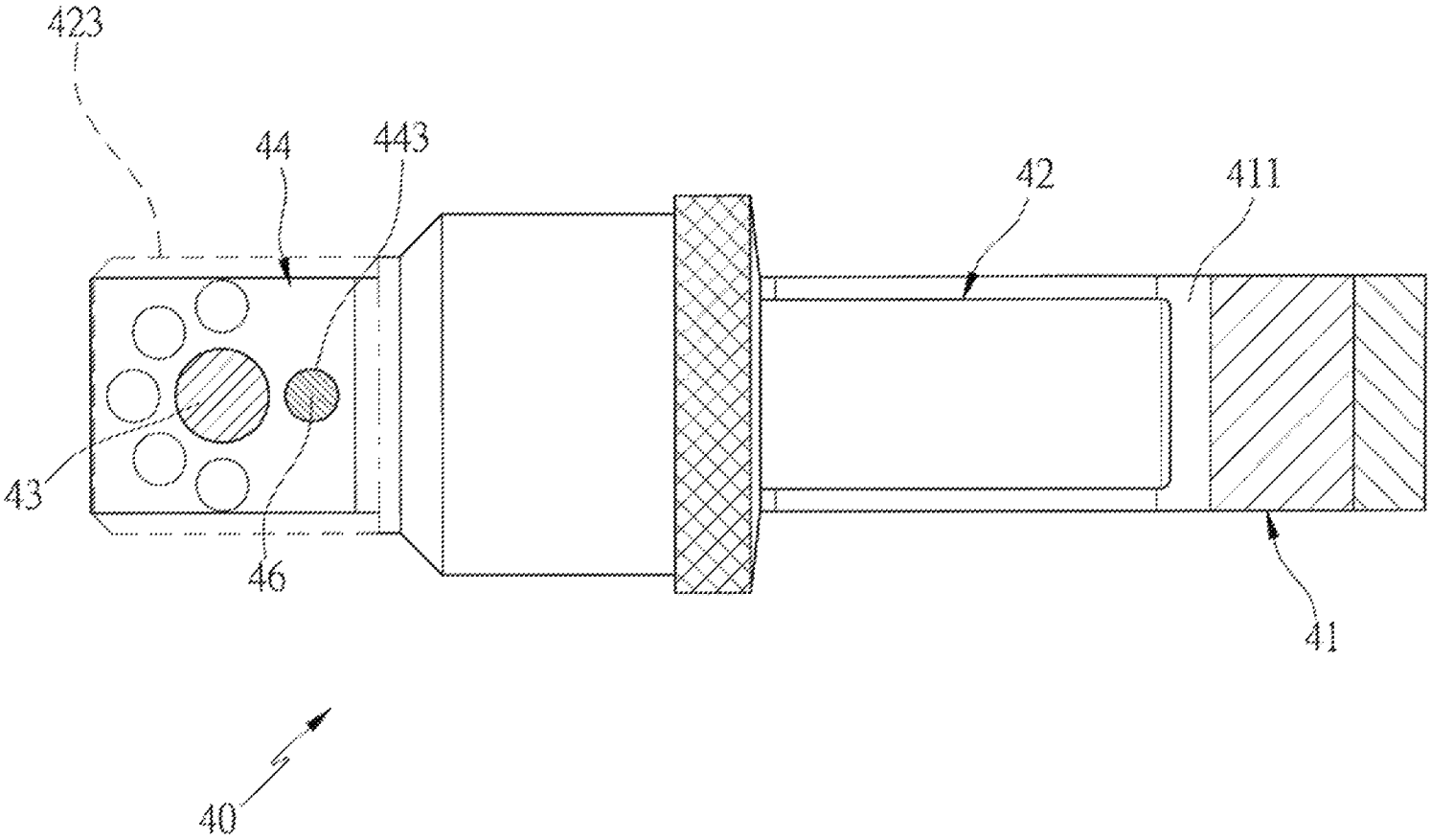
FIG. 19 is a partial side cross sectional view to show that the working part is received in the handle of the second embodiment of the present invention.
Figure 20:
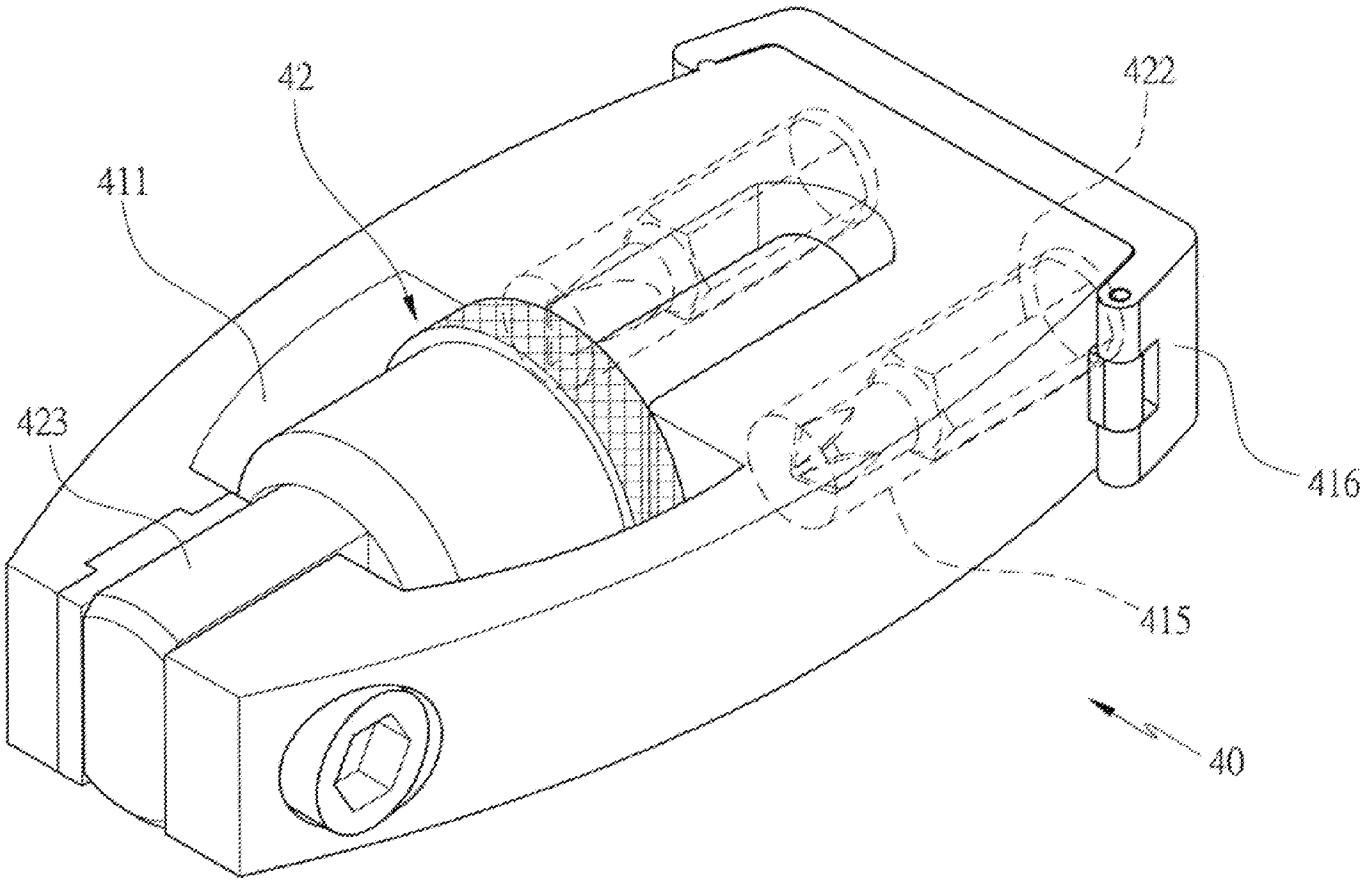
FIG. 20 is a perspective view to show that the working part is received in the handle of the second embodiment of the present invention.

As shown in FIGS. 19 and 20, the working part 42 is pivoted toward the handle 41 and received in the room 411 in the handle 41, wherein the positioning member 46 is engaged with the second recess 443 to keep the working part 42 is received in the room 411 in the handle 41.

While we have shown and described the embodiment in accordance with the present invention, it should be clear to those skilled in the art that further embodiments may be made without departing from the scope of the present invention.

What is claimed is:

1. A hand tool comprising:

a handle which is a one-piece handle and having a room defined therein, a first lug and a second lug extending from a front end of the handle, a space defined between the first and second lugs and communicating with the room;

a working part having a first end and a second end, the first end adapted to be connected with a bit, a pivotal portion formed on the second end of the working part, the pivotal portion inserted in the space and pivotably connected between the first and second lugs by extending a pin through the first and second lugs and the pivotal portion, and a plate connected to at least one of the first and second lugs, the plate having multiple first recesses and a second recesses defined in a first side thereof, a positioning member located between the pivotal portion and the plate so as be engaged with one of the first and second recesses.

2. The hand tool as claimed in claim 1, wherein the handle is a U-shaped handle and the room is a substantially oval-shaped room which extends through the handle.

3. The hand tool as claimed in claim 1, wherein the handle is a U-shaped handle and the room is a substantially T-shaped room which extends through the handle.

4. The hand tool as claimed in claim 1, wherein the handle includes multiple receiving recesses defined in the second end thereof, a cap is pivotably connected to the second end of the handle and seals the receiving recesses, the receiving recesses are adapted to receive bits.

5. The hand tool as claimed in claim 1, wherein the first lug has a stepped hole and the second lug has a threaded hole, the pivotal portion of the working part has a passage, the pin extends through the stepped hole and the passage, and is threadedly connected to the threaded hole.

6. The hand tool as claimed in claim 1, wherein the pivotal portion has a reception recess, a resilient member and the positioning member are received in the reception recess, the positioning member is biased by the resilient member and engaged with one of the first and second recesses.

7. The hand tool as claimed in claim 1, wherein the plate has an aperture through which the pin extends.

8. The hand tool as claimed in claim 7, wherein the first recesses of the plate are located closer to the first end of the handle than the second recess.

9. The hand tool as claimed in claim 1, wherein the plate has a ridge extending from a second side thereof, the second lug includes a slot in which the ridge slides.

10. The hand tool as claimed in claim 1, wherein the plate is made by way of powder metallurgy.

* * * * *